US011742621B2

(12) United States Patent
Lin

(10) Patent No.: US 11,742,621 B2
(45) Date of Patent: Aug. 29, 2023

(54) ELECTRICAL CONNECTOR AND ELECTRICAL CONNECTOR ASSEMBLY WITH IMPROVED SHIELDING PERFORMANCE

(71) Applicant: DONGGUAN LUXSHARE TECHNOLOGIES CO., LTD, Dongguan (CN)

(72) Inventor: Yanbo Lin, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 164 days.

(21) Appl. No.: 17/397,281

(22) Filed: Aug. 9, 2021

(65) Prior Publication Data

US 2022/0115820 A1 Apr. 14, 2022

(30) Foreign Application Priority Data

Oct. 9, 2020 (CN) ..... 202011073621.4

(51) Int. Cl.
*H01R 13/6587* (2011.01)
*H01R 13/506* (2006.01)
*H01R 13/6461* (2011.01)

(52) U.S. Cl.
CPC ..... *H01R 13/6587* (2013.01); *H01R 13/506* (2013.01); *H01R 13/6461* (2013.01)

(58) Field of Classification Search
CPC .. H01R 12/724; H01R 13/506; H01R 13/648; H01R 13/6461; H01R 13/6581; H01R 13/6582; H01R 13/6586; H01R 13/6587
See application file for complete search history.

(56) References Cited

U.S. PATENT DOCUMENTS 8,444,434 B2 * 5/2013 Davis ..... H01R 13/6587 439/607.07
8,579,636 B2 * 11/2013 Davis ..... H05K 1/141 439/65

(Continued)

FOREIGN PATENT DOCUMENTS

CN 102005674 A 4/2011
CN 102904120 A 1/2013

(Continued)

*Primary Examiner* — Oscar C Jimenez
(74) *Attorney, Agent, or Firm* — Birch, Stewart, Kolasch & Birch, LLP

(57) ABSTRACT

An electrical connector includes a conductive body, a terminal module and a grounding element. The conductive body includes a mating cavity and a slot for fixing the grounding element. The terminal module includes an insulating block, a plurality of signal terminals and a grounding piece mounted to the insulating block. The grounding piece includes a ground terminal. The ground terminal includes a ground contact portion at least partially located in the mating cavity. The grounding element includes a ground mating portion at least partially located in the mating cavity. The ground contact portion and the ground mating portion are adapted to be in contact with a same ground pin of a mating connector. As a result, a stable loop can be formed and the shielding performance of the electrical connector is improved. Besides, an electrical connector assembly having the electrical connector is disclosed.

16 Claims, 19 Drawing Sheets

(56) References Cited

U.S. PATENT DOCUMENTS

| | | | | |
|---|---|---|---|---|
| 8,888,531 | B2 | 11/2014 | Jeon | |
| 10,186,811 | B1 * | 1/2019 | Trout | H01R 13/428 |
| 11,469,554 | B2 * | 10/2022 | Ellison | H01R 13/6587 |
| 2014/0148054 | A1 * | 5/2014 | Annis | H01R 13/6588<br>439/607.05 |
| 2015/0044888 | A1 | 2/2015 | Tamai | |
| 2019/0305486 | A1 * | 10/2019 | Trout | H01R 13/6583 |

FOREIGN PATENT DOCUMENTS

| | | | |
|---|---|---|---|
| CN | 103151627 | A | 6/2013 |
| CN | 103840320 | A | 6/2014 |
| CN | 104094474 | A | 10/2014 |
| CN | 108365362 | A | 8/2018 |
| CN | 210129629 | U | 3/2020 |
| CN | 210224355 | U | 3/2020 |
| DE | 20 2010 008 425 | U1 | 12/2010 |
| TW | 201505292 | A | 2/2015 |

* cited by examiner

ELECTRICAL CONNECTOR AND ELECTRICAL CONNECTOR ASSEMBLY WITH IMPROVED SHIELDING PERFORMANCE

CROSS-REFERENCE TO RELATED APPLICATION

This patent application claims priority of a Chinese Patent Application No. 202011073621.4, filed on Oct. 9, 2020 and titled "ELECTRICAL CONNECTOR", the entire content of which is incorporated herein by reference.

TECHNICAL FIELD

The present disclosure relates to an electrical connector and electrical connector assembly, which belongs to a technical field of connectors.

BACKGROUND

Existing electrical connectors (such as high-frequency backplane connectors) usually use high-frequency bands to transmit signals, so electromagnetic interference (EMI) problems (such as crosstalk or noise) are likely to occur around terminals that are transmitting high-frequency signals. In order to solve the above-mentioned problems, grounding terminals can be used between signal terminals to shield different signal terminals so as to improve electromagnetic interference. Although the shielding function is provided by setting the ground terminals between the signal terminals, the overall connector transmission performance has not yet reached the expected effect, and there is still room for improvement.

SUMMARY

An object of the present disclosure is to provide an electrical connector and an electrical connector assembly with better shielding performance.

In order to achieve the above object, the present disclosure adopts the following technical solution: an electrical connector, comprising: a conductive body, the conductive body comprising a first end surface, a second end surface away from the first end surface, and a mating cavity extending through the first end surface; and a terminal module, the terminal module being assembled to the conductive body from the second end surface, the terminal module comprising an insulating block, a plurality of signal terminals fixed to the insulating block, and a grounding piece mounted to the insulating block, the grounding piece comprising a body portion located on a side surface of the insulating block and a ground terminal connected to the body portion, the ground terminal comprising a ground contact portion at least partially located in the mating cavity; wherein the conductive body further defines a slot extending through the first end surface in a direction opposite to an insertion direction of a mating connector; the electrical connector comprises a grounding element retained in the slot, the grounding element comprises a ground mating portion at least partially located in the mating cavity, and the ground contact portion and the ground mating portion are adapted to contact a same ground pin of the mating connector.

In order to achieve the above object, the present disclosure adopts the following technical solution: an electrical connector assembly, comprising: an electrical connector, comprising: a conductive body, the conductive body comprising a first end surface, a mating cavity extending through the first end surface, and a slot extending through the first end surface; a terminal module, the terminal module being assembled to the conductive body, the terminal module comprising an insulating block, a plurality of signal terminals fixed to the insulating block, and a grounding piece mounted to the insulating block, the grounding piece comprising a body portion located on a side surface of the insulating block and a ground terminal connected to the body portion, the ground terminal comprising a ground contact portion at least partially located in the mating cavity; and a grounding element retained in the slot, the grounding element comprising a ground mating portion at least partially located in the mating cavity, the ground contact portion and the ground mating portion being located on opposite sides of the mating cavity, respectively; and a mating connector, comprising a ground pin; wherein when the mating connector is mating with the electrical connector along an insertion direction, the ground pin is received in the mating cavity, and the ground pin of the mating connector is clamped by the ground contact portion and the ground mating portion of the electrical connector.

Compared with the prior art, the present disclosure comprises the grounding piece fixed in the slot, and the ground contact portion and the ground mating portion are adapted to be in contact with the same ground pin of the mating connector, thereby forming a stable loop and improving the shielding performance of the electrical connector and the electrical connector assembly.

DETAILED DESCRIPTION

Figure 1:
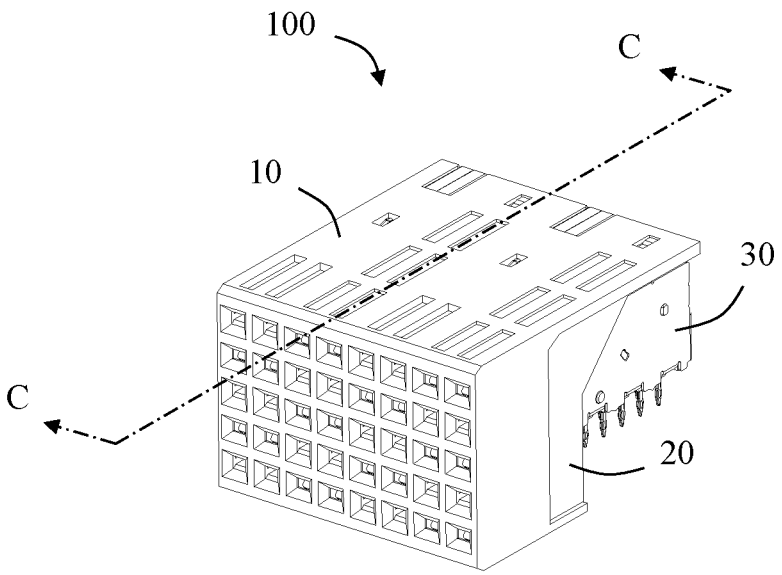
FIG. 1 is a perspective schematic view of an electrical connector in accordance with an embodiment of the present disclosure.
Figure 2:
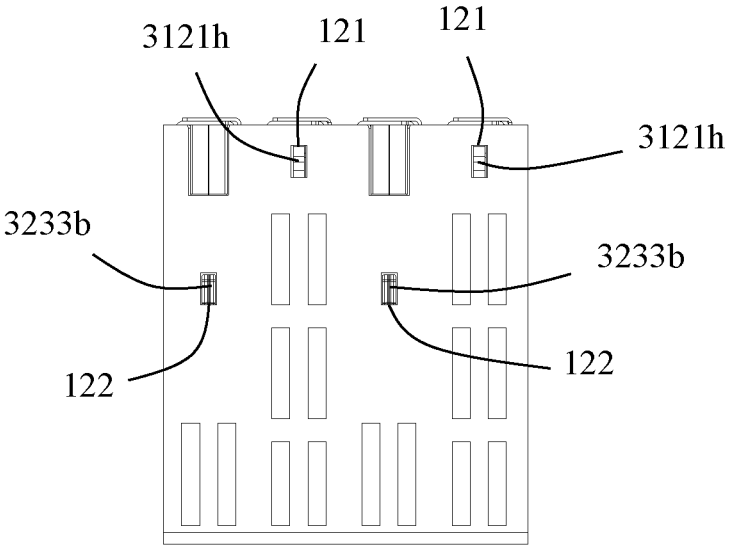
FIG. 2 is a top view of FIG. 1.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 19:
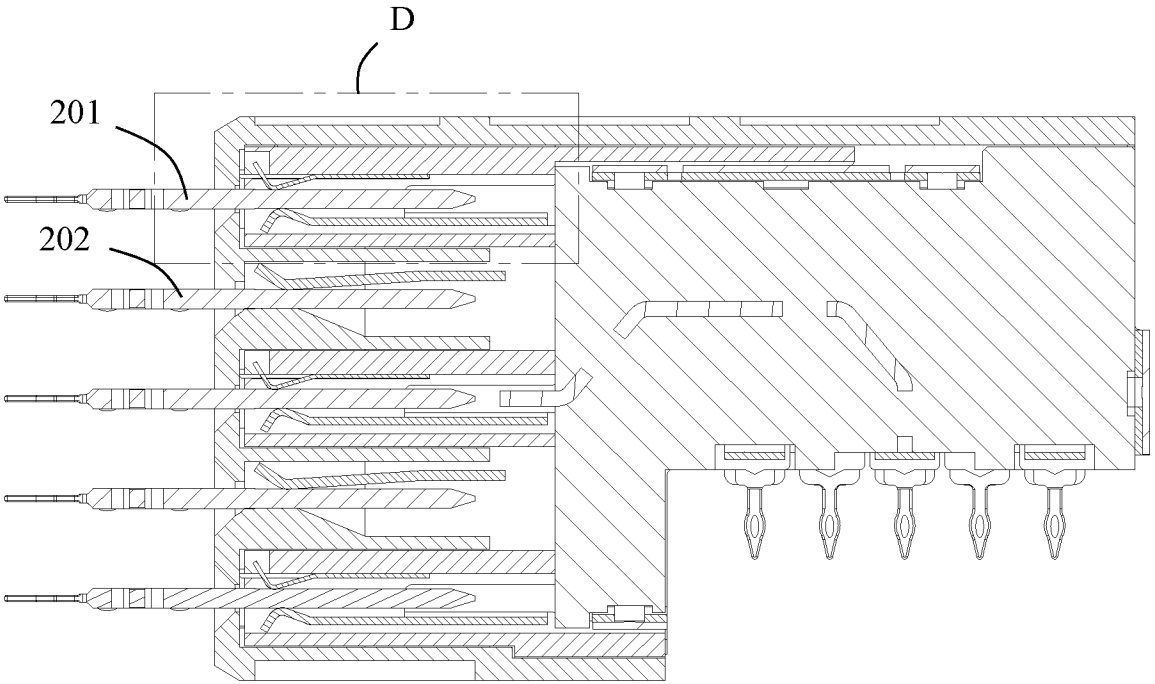
FIG. 19 is a schematic cross-sectional view of an electrical connector assembly when terminals of a mating connector are inserted into the electrical connector with the grounding piece in the first embodiment of the present disclosure.
Figure 20:
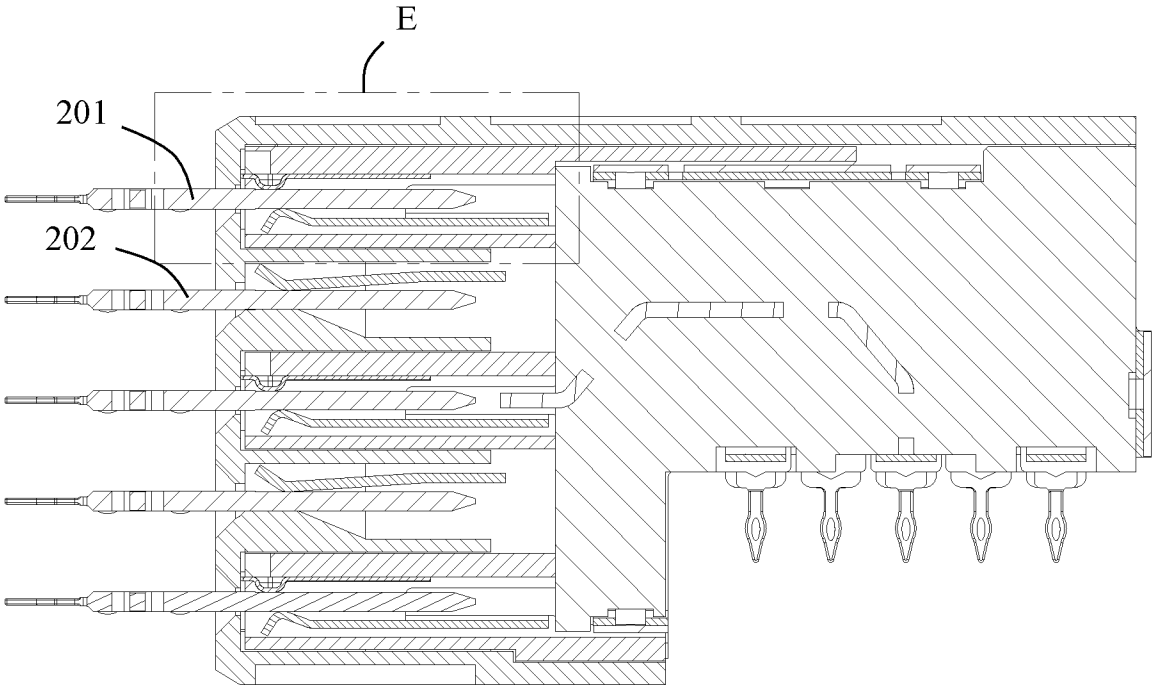
FIG. 20 is a schematic cross-sectional view of the electrical connector assembly when the terminals of the mating connector are inserted into the electrical connector with the grounding piece in the second embodiment of the present disclosure.

Referring to FIG. 1, the present disclosure discloses an electrical connector 100 which is used to mate with a mating connector (not shown) for data transmission. In the illustrated embodiment of the present disclosure, the electrical connector 100 is a high-speed backplane connector. Referring to FIGS. 19 and 20, the mating connector includes a plurality of ground pins 201 and a plurality of mating signal terminals 202.

Referring to FIGS. 1 to 4, the electrical connector 100 includes an outer housing 10, a conductive body 20 assembled to the outer housing 100, and a plurality of terminal modules 30 assembled to the conductive body 20.

In an embodiment of the present disclosure, the outer housing 10 is made of an insulating material. The outer housing 10 includes a mating body 11, a top wall 12 extending backwardly from a top of the mating body 11, and a bottom wall 13 extending backwardly from a bottom of the mating body 11. The top wall 12 and the bottom wall 13 are parallel to each other and both are perpendicular to the mating body 11. The mating body 11 defines a plurality of terminal receiving holes 110 arranged in a matrix for insertion of the ground pins 201 and the mating signal terminals 202 of the mating connector along an insertion direction M (i.e., a front-to-rear direction). The top wall 12 defines a plurality of first locking grooves 121 located at a rear end thereof and a plurality of second locking grooves 122 located approximately in the middle thereof. The first locking grooves 121 are farther away from the mating body 11 than the second locking grooves 122. The plurality of first locking grooves 121 are aligned in a width direction W-W (i.e., a left-right direction) of the outer housing 10. The plurality of second locking grooves 122 are also aligned in the width direction W-W of the outer housing 10. Along the width direction W-W of the outer housing 10, adjacent first locking groove 121 and the second locking groove 122 are arranged in a staggered manner. The first locking grooves 121 and the second locking grooves 122 are used to lock with corresponding terminal modules 30 so as to prevent the terminal modules 30 from being separated backwardly from the outer housing 10. In addition, referring to FIG. 4, a bottom surface of the top wall 12 also defines a plurality of guiding grooves 123 and a plurality of inclined surfaces of which each is inclined outwardly and located at least one end of each guiding groove 123. The bottom wall 13 includes a third holding groove 131 for holding a protrusion 211 of the conductive body 20. In addition, the bottom surface of the top wall 12 also includes a plurality of dovetail grooves 124 and a plurality of retaining slots 125 for fixing the corresponding terminal modules 30.

In an embodiment of the present disclosure, the conductive body 20 can be made of an electroplated plastic. The electroplated plastic is made of an insulating material as a base and electroplating plastic on surfaces of the base. In other embodiments, the conductive body 20 may also be made of a conductive plastic. Referring to FIGS. 5 to 10, the conductive body 20 includes a first end surface 21 (i.e., a front end surface), a second end surface 22 (i.e., a rear end surface) away from the first end surface 21, and a plurality of mating cavities 23 extending through the first end surface 21 and the second end surface 22. The conductive body 20 further includes a plurality of mating extensions 24 protruding forwardly and a plurality of receiving spaces 25 of which each is located between two adjacent mating extensions 24 along a spacing direction N (i.e., a top-bottom direction). Two mating extensions 24 adjacent to each other in a left-right direction are staggered. Correspondingly, two receiving spaces 25 adjacent to each other in the left-right direction are also staggered. In the illustrated embodiment of the present disclosure, each mating cavity 23 includes a first mating cavity 231 and a second mating cavity 232 which extend through corresponding mating extension 24 in a direction opposite to an insertion direction M. The first mating cavity 231 and the second mating cavity 232 are arranged side by side in the left-right direction. Each mating extension 24 includes a partition wall 241 separating the first mating cavity 231 and the second mating cavity 232. The top wall 28 of the conductive body 20 includes a plurality of ribs 29. Each rib 29 includes an inclined inner side surface. The ribs 29 are adapted to mate with the guiding grooves 123 of the outer housing 10. With this arrangement, on one hand, when the conductive body 20 is assembled to the outer housing 10, the conductive body 20 can be easily installed and guided; on the other hand, after the conductive body 20 is assembled to the outer housing 10, the conductive body 20 can be restricted from being separated from the outer housing 10 in the top-bottom direction.

Figure 5:
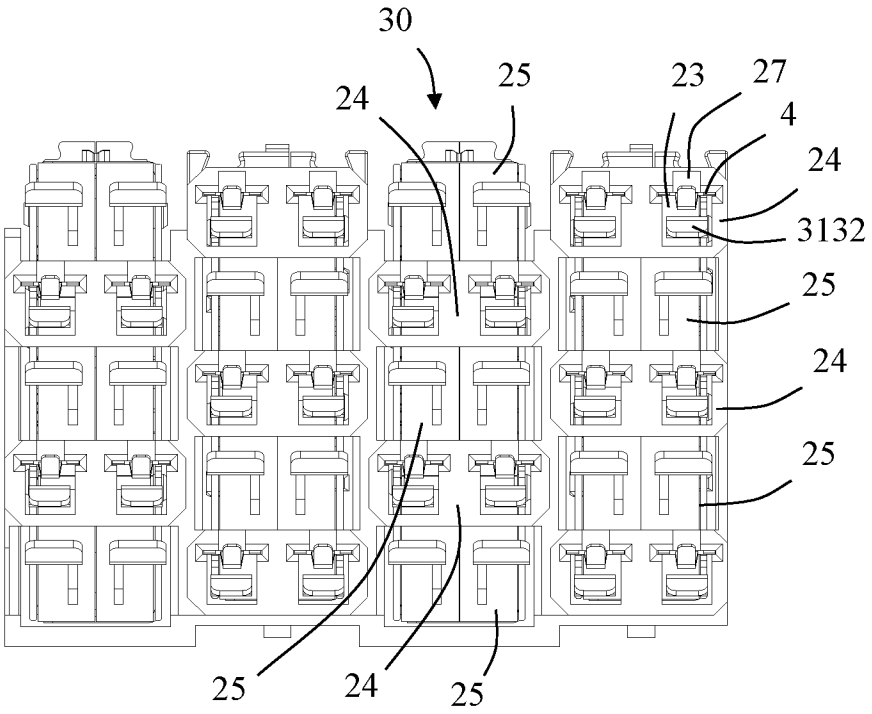
FIG. 5 is a front view after removing an outer housing in FIG. 3.
Figure 6:
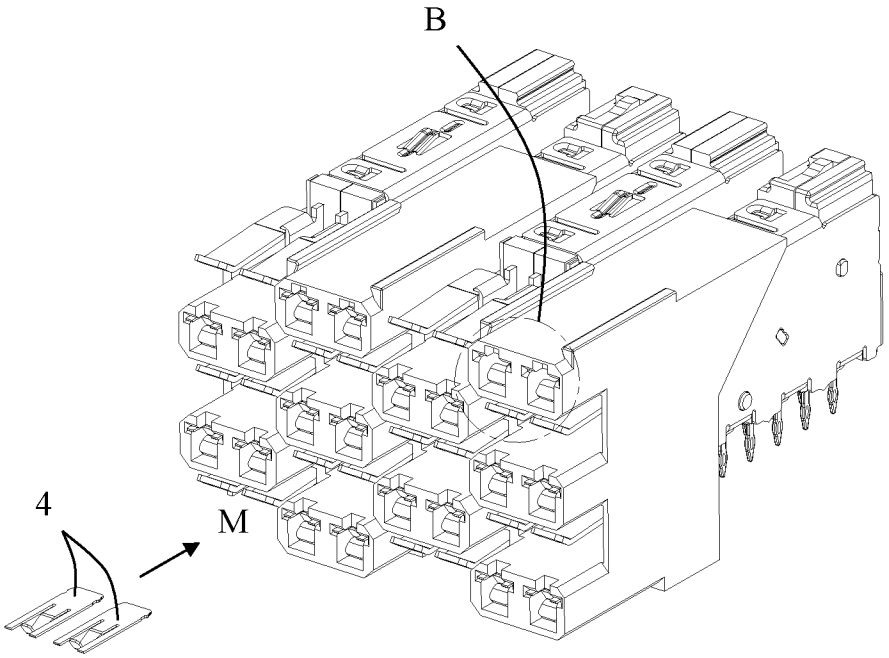
FIG. 6 is a further perspective exploded view of FIG. 5, in which two grounding pieces are separated.
Figure 7:
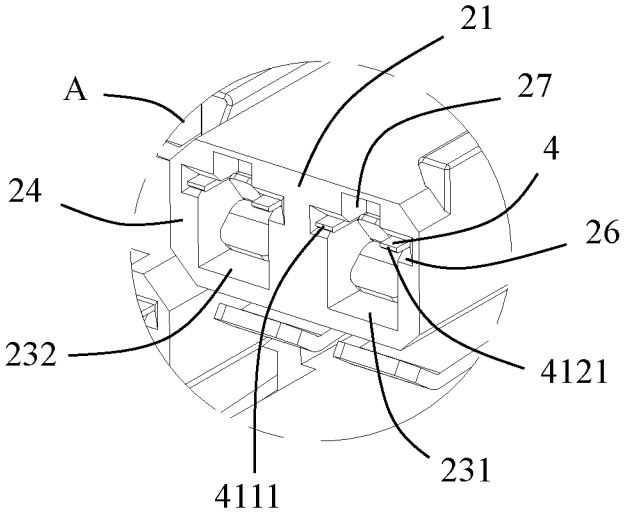
FIG. 7 is a partial enlarged view of a circled portion A in FIG. 3.
Figure 8:
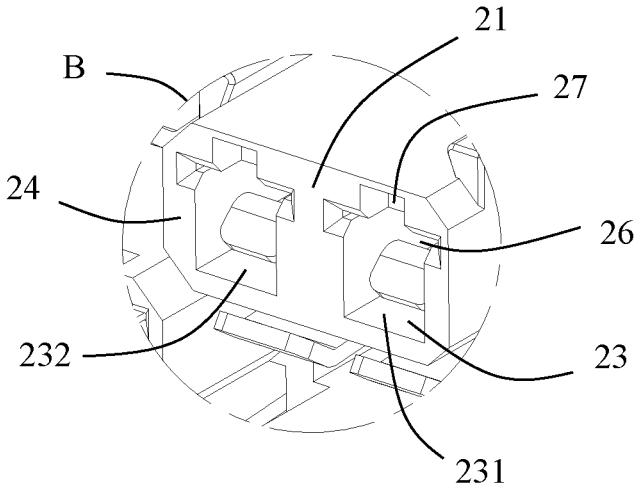
FIG. 8 is a partial enlarged view of a circled portion B in FIG. 6.
Figure 9:
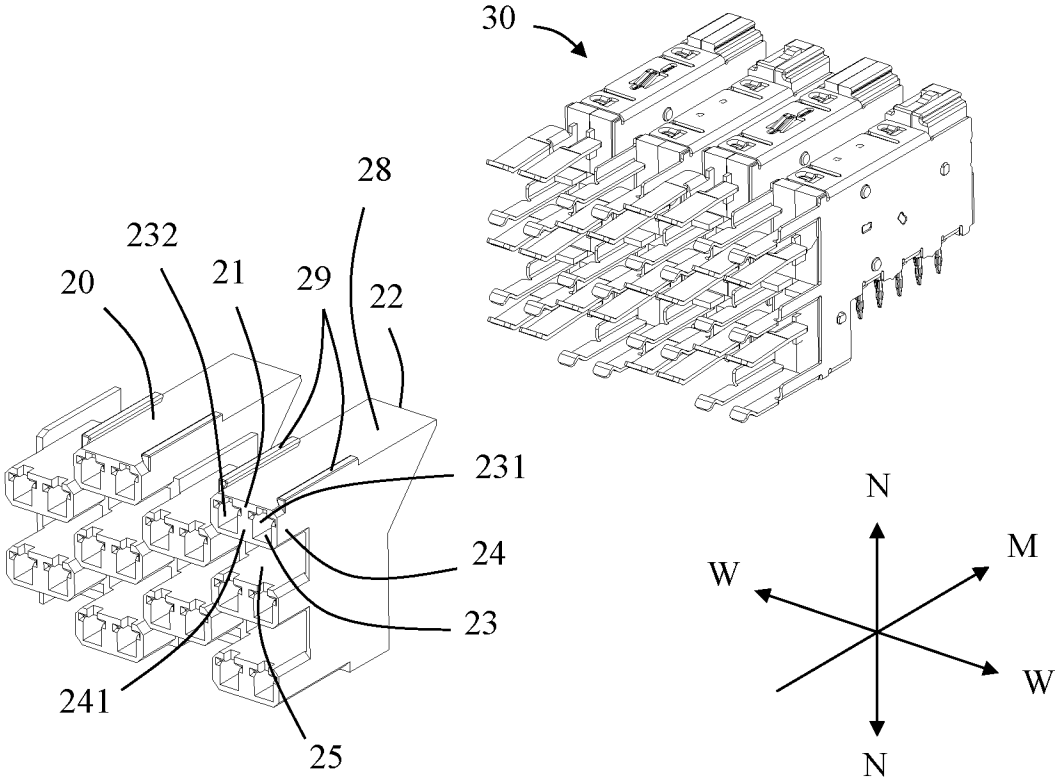
FIG. 9 is a schematic view when the conductive body and the terminal modules are separated.
Figure 10:
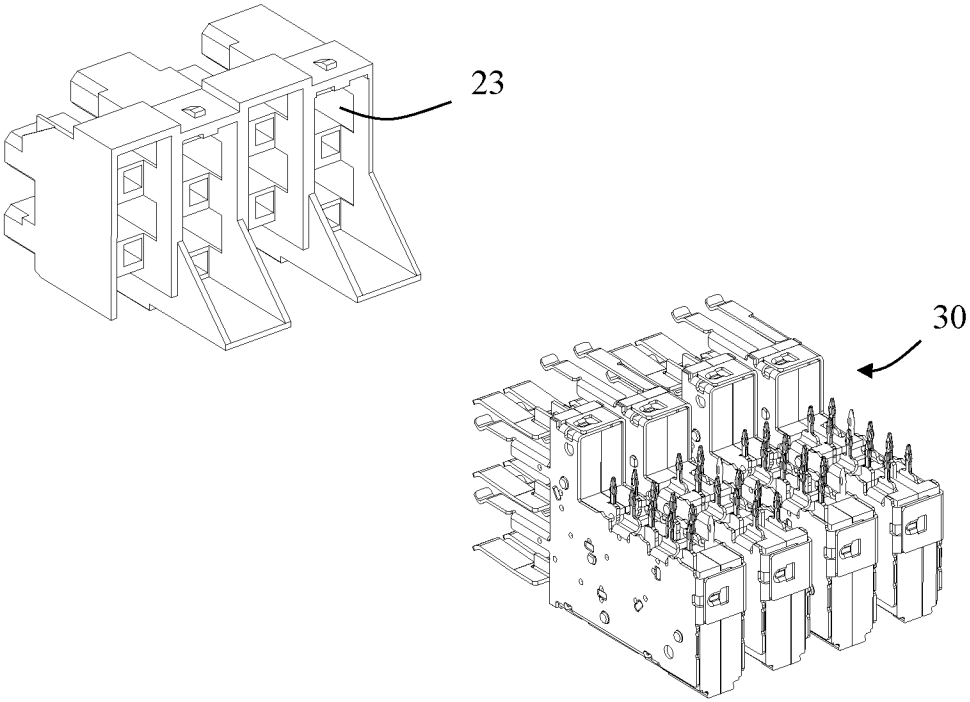
FIG. 10 is a schematic view of FIG. 9 from another angle.

Referring to FIGS. 5 and 8, corresponding to each mating extension 24, the conductive body 20 includes a slot 26 which extends through the first end surface 21 in a direction opposite to the insertion direction M of the mating connector. The slot 26 communicates with the corresponding mating cavity 23 so as to form a T-shaped cavity. In an embodiment of the present disclosure, a width of the slot 26 in the left-right direction is greater than a width of the mating cavity 23 in the left-right direction. A bottom surface of the slot 26 and a side surface of the mating cavity 23 are perpendicular to each other. In addition, the conductive body 20 includes a receiving groove 27 communicating with the slot 26. In the illustrated embodiment of the present disclosure, the receiving groove 27 is approximately located in the top middle of the slot 26.

Figure 11:
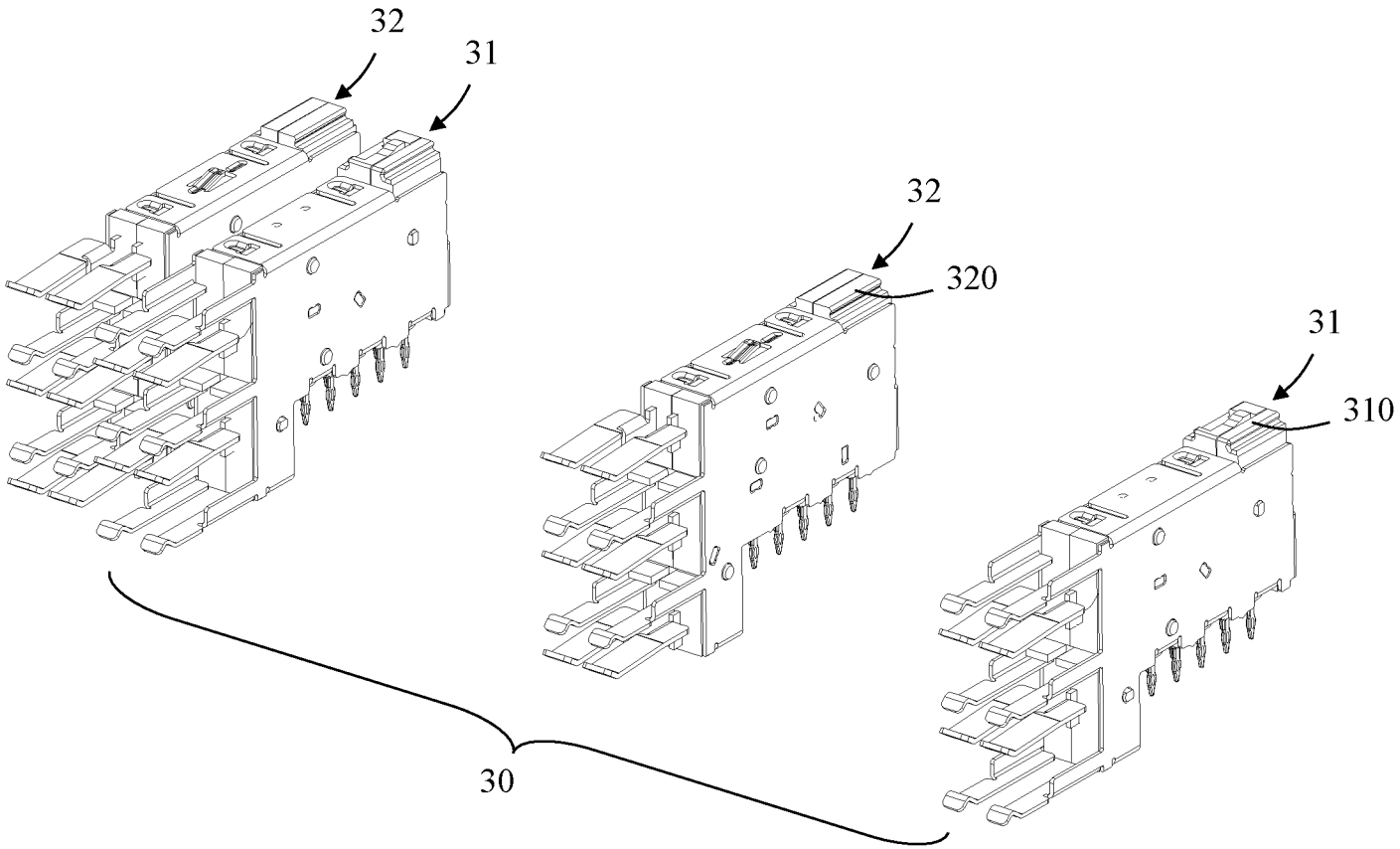
FIG. 11 is a schematic view of part of the terminal modules in FIG. 9 when they are separated.

Referring to FIG. 11, in the illustrated embodiment of the present disclosure, the terminal module 30 includes a plurality of first terminal modules 31 and a plurality of second terminal modules 32. The first terminal modules 31 and the second terminal modules 32 are arranged alternately along a stacking direction (that is, the left-right direction in the illustrated embodiment of the present disclosure), and are arranged side by side. The first terminal modules 31 and the second terminal modules 32 are assembled and fixed to the conductive body 20 in a direction opposite to the insertion direction M.

Figure 12:
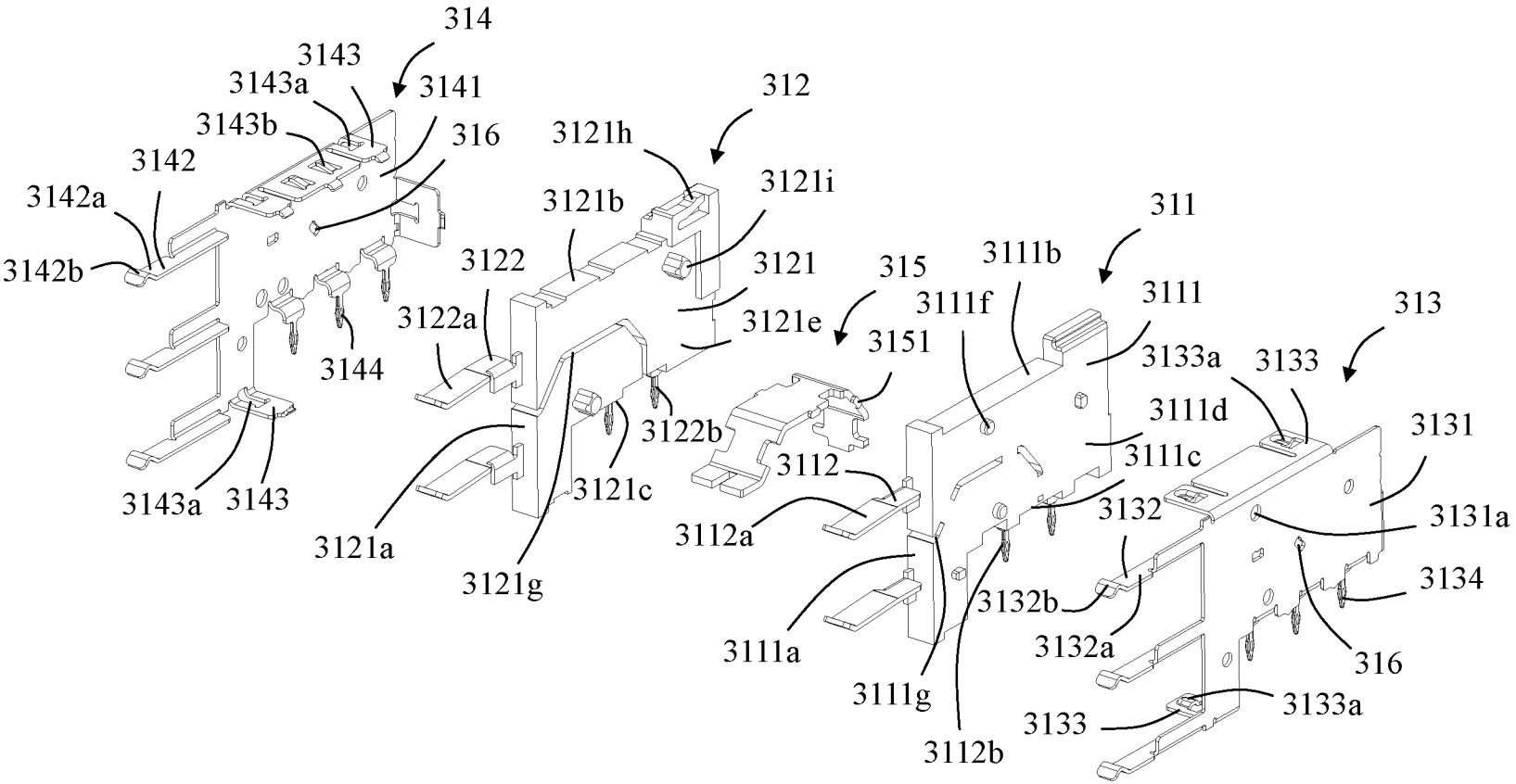
FIG. 12 is an exploded perspective view of a first terminal module in FIG. 11.
Figure 13:
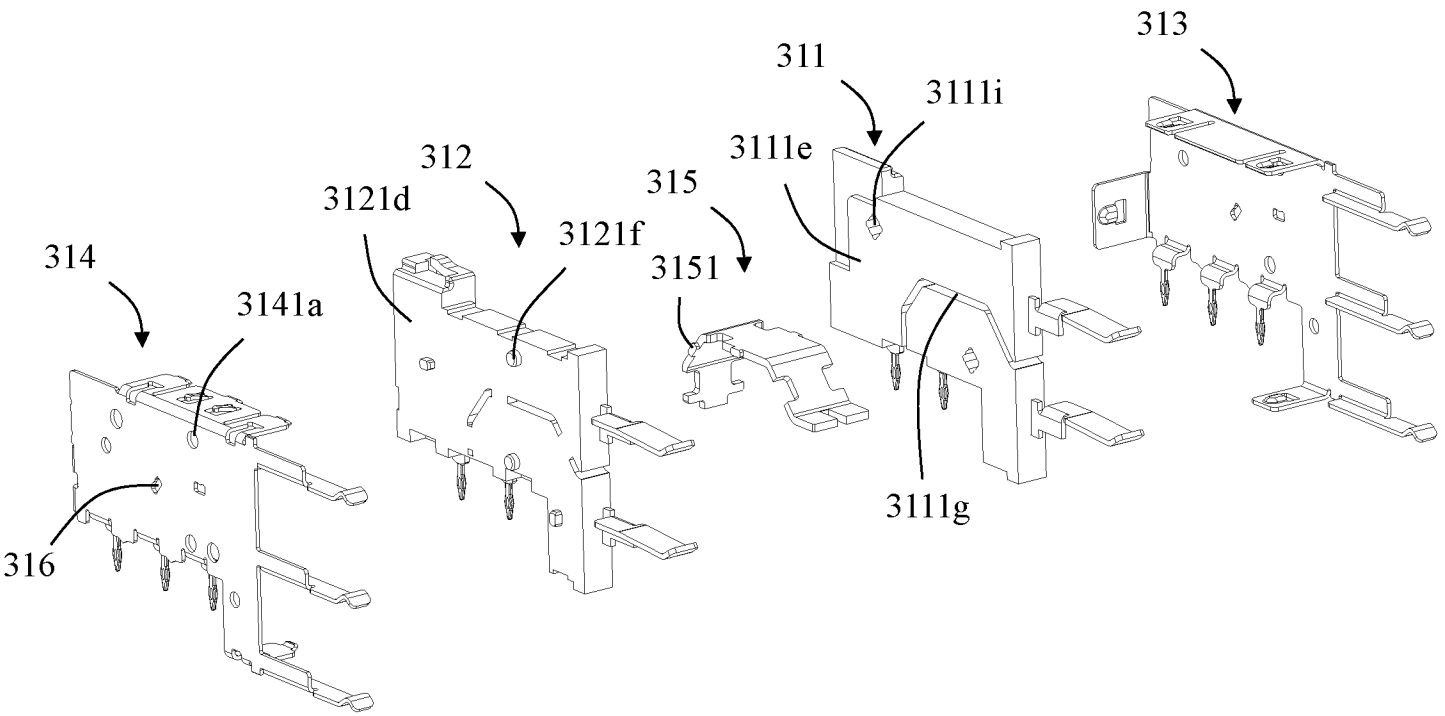
FIG. 13 is a perspective exploded view of FIG. 12 from another angle.

Referring to FIGS. 11 to 13, in the illustrated embodiment of the present disclosure, each first terminal module 31 includes a first signal terminal module 311, a second signal terminal module 312, a first grounding piece 313 located on one side of the first signal terminal module 311, a second grounding piece 314 located on the other side of the second signal terminal module 312, and a first ground shielding piece 315 held in the first signal terminal module 311 and the second signal terminal module 312.

The first signal terminal module 311 includes a first insulating block 3111 and a plurality of first signal terminals 3112 fixed to the first insulating block 3111. In an embodiment of the present disclosure, the first signal terminals 3112 are insert-molded with the first insulating block 3111. The first insulating block 3111 includes a first front end surface 3111*a*, a first top surface 3111*b*, a first bottom surface 3111*c*, a first side surface 3111*d* facing the first grounding piece 313, and a second side surface 3111*e* facing the second signal terminal module 312. The first insulating block 3111 further includes a plurality of first fixing posts 3111*f* protruding beyond the first side surface 3111*d* and a first installation slot 3111*g* extending through the second side surface 3111*e*. In the illustrated embodiment of the present disclosure, the first installation slot 3111*g* does not extend at least partially through the first side surface 3111*d* so as to ensure the structural strength of the first signal terminal module 311. In the illustrated embodiment of the present disclosure, the first installation slot 3111*g* extends through the first front end surface 3111*a*.

The first signal terminal 3112 includes a first contact arm 3112*a* protruding forwardly beyond the first front end surface 3111*a* and a first mounting foot 3112*b* protruding downwardly beyond the first bottom surface 3111*c*.

The second signal terminal module 312 includes a second insulating block 3121 and a plurality of second signal terminals 3122 fixed to the second insulating block 3121. In an embodiment of the present disclosure, the second signal terminals 3122 are insert-molded with the second insulating block 3121. The second insulating block 3121 includes a second front end surface 3121*a*, a second top surface 3121*b*, a second bottom surface 3121*c*, a third side surface 3121*d* facing the second grounding piece 314, and a fourth side surface 3121*e* facing the first signal terminal module 311. The second insulating block 3121 also includes a plurality of second fixing posts 3121*f* protruding beyond the third side surface 3121*d*, and a second installation slot 3121*g* extending through the fourth side surface 3121*e*. In the illustrated embodiment of the present disclosure, the second installation slot 3121*g* does not extend at least partially through the third side surface 3121*d* so as to ensure the structural strength of the second signal terminal module 312. In the illustrated embodiment of the present disclosure, the second installation slot 3121*g* extends through the second front end surface 3121*a*.

The first insulating block 3111 and the second insulating block 3121 are disposed side by side. The first insulating block 3111 and the second insulating block 3121 include a protrusion 3121*i* and a grooves 3111*i* which mate with each other. The protrusion 3121*i* is provided on one of the first insulating block 3111 and the second insulating block 3121, and the groove 3111*i* is provided on the other of the first insulating block 3111 and the second insulating block 3121. This arrangement is beneficial for assembling the first insulating block 3111 and the second insulating block 3121 as a whole. Referring to FIGS. 12 and 13, in the illustrated embodiment of the present disclosure, the groove 3111*i* is defined in the first insulating block 3111, and the protrusion 3121*i* is provided on the second insulating block 3121.

One side of the first ground shielding piece 315 is received in the first installation slot 3111*g*, and the other side of the first ground shielding piece 315 is received in the second installation slot 3121*g*. That is, the first installation slot 3111*g* and the second installation slot 3121*g* together receive the first ground shielding piece 315.

Figure 3:
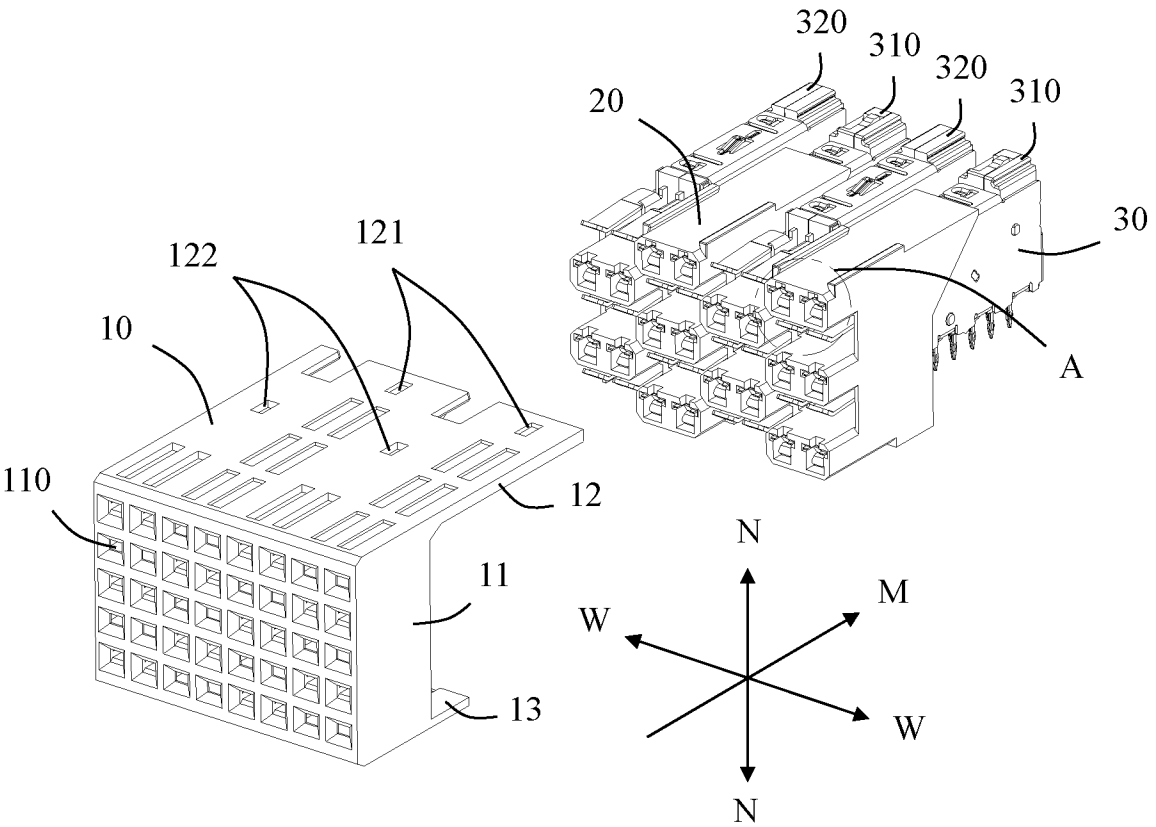
FIG. 3 is a partially exploded perspective view of FIG. 1.
Figure 4:
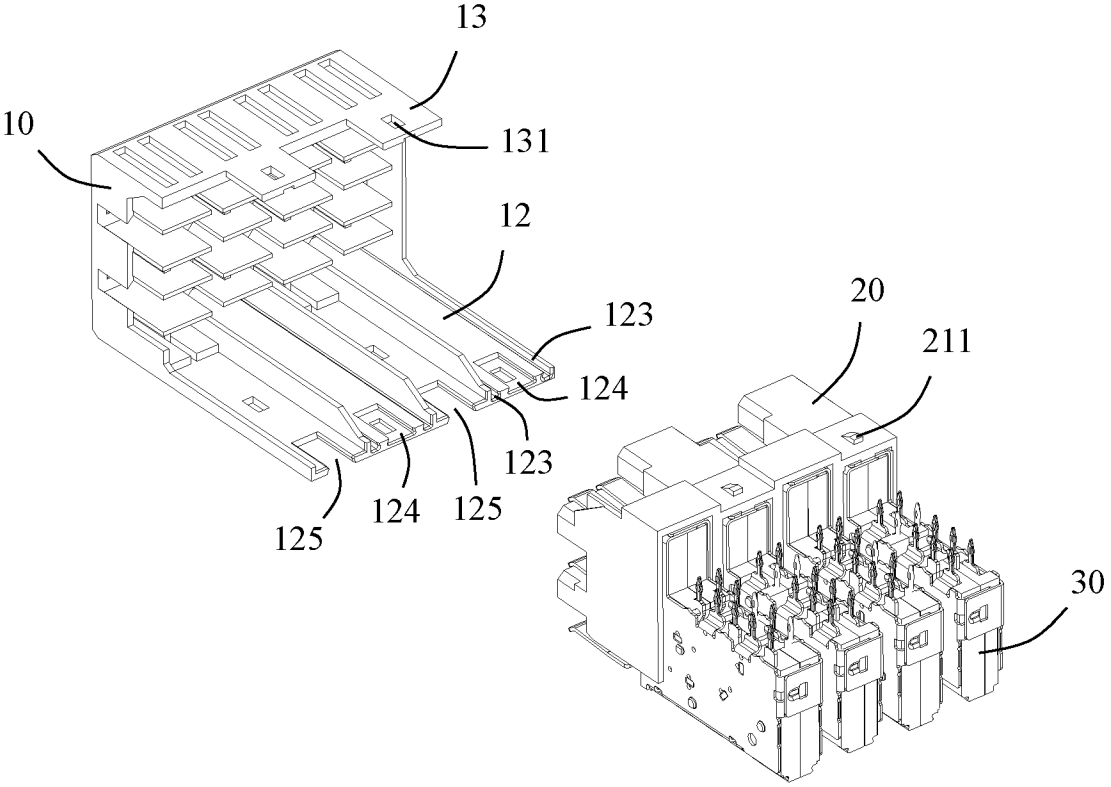
FIG. 4 is a partially exploded perspective view of FIG. 3 from another angle.

In addition, the first insulating block 3111 and/or the second insulating block 3121 includes a plastic abutting arm 3121*h* protruding upwardly. In the illustrated embodiment of the present disclosure, the plastic abutting arm 3121*h* is integrally formed with the second insulating block 3121, and protrudes upwardly beyond the second top surface 3121*b*. The plastic abutting arm 3121*h* is used to be locked in the corresponding first locking groove 121 so as to prevent the first terminal module 31 from being separated from the outer housing 10 backwards. Of course, in other embodiments, the plastic abutting arm 3121*h* can also be integrally formed with the first insulating block 3111, and protrude upwardly from the first top surface 3111*b*. Alternatively, each of the first insulating block 3111 and the second insulating block 3121 include the plastic abutting arm 3121*h*, and the plastic abutting arms 3121*h* are arranged side by side with each other. In addition, as shown in FIGS. 3, 4 and 11, the first insulating block 3111 and the second insulating block 3121 are spliced to form a holding protrusion 310 for jointly being retained in the corresponding dovetail groove 124. In other words, a part of the structure of the holding protrusion 310 is formed on the first insulating block 3111, and another part of the structure of the holding protrusion 310 is formed on the second insulating block 3121. When assembling the first terminal module 31 to the outer housing 10, the holding protrusion 310 and the corresponding dovetail groove 124 are mated with each other, thereby guiding the assembly on one hand; and preventing the first insulating block 3111 and the second insulating block 3121 from being loose with each other on the other hand.

The second signal terminal 3122 includes a second contact arm 3122*a* protruding forwardly beyond the second front end surface 3121*a* and a second mounting foot 3122*b* protruding downwardly beyond the second bottom surface 3121*c*.

The first grounding piece 313 includes a first body portion 3131, a plurality of first ground terminals 3132 extending forwardly from the first body portion 3131, first bending portions 3133 bent from the top and the bottom of the first body portion 3131 respectively and extending to a side of the second grounding piece 314, and a plurality of first ground pins 3134 extending downwardly from the bottom of the first body portion 3131. The first body portion 3131 includes a plurality of first positioning holes 3131*a* mating with the first fixing posts 3111*f*. The first ground terminal 3132 includes a first ground arm 3132*a* and a first ground contact portion 3132*b* located on the first ground arm 3132*a*. The first ground contact portion 3132*b* has an arc-shaped contact surface.

The second grounding piece 314 includes a second body portion 3141, a plurality of second ground terminals 3142 extending forwardly from the second body portion 3141, second bending portions 3143 bent from the top and the bottom of the second body portion 3141 respectively and extending to a side of the first grounding piece 313, and a plurality of second ground pins 3144 extending downwardly from the bottom of the second body portion 3141. The second body portion 3141 includes a plurality of second positioning holes 3141*a* mating with the second fixing posts 3121*f*. The second ground terminal 3142 includes a second ground arm 3142*a* and a second ground contact portion 3142*b* located on the second ground arm 3142*a*. The second ground contact portion 3142*b* has an arc-shaped contact surface.

In an embodiment of the present disclosure, when assembling the first terminal module 31, firstly, two sides of the first ground shielding piece 315 are inserted into the first installation slot 3111*g* of the first insulating block 3111 and the second installation slot 3121*g* of the second insulating block 3121, respectively. Then, the first insulating block 3111 and the second insulating block 3121 are brought close to each other to initially combine as a whole. After that, the first grounding piece 313 and the second grounding piece 314 are respectively installed from two sides to two side surfaces of the first insulating block 3111 and the second insulating block 3121. The two side surfaces (i.e., the first side surface 3111*d* and the third side surface 3121*d*) are away from each other. Through the cooperation of the first fixing post 3111*f* and the first positioning hole 3131*a* and the cooperation of the second fixing post 3121*f* and the second positioning hole 3141*a*, the first grounding piece 313 and the second grounding piece 314 are installed to the first insulating block 3111 and the second insulating block 3121. Finally, the first bending portion 3133 and the second bending portion 3143 are fixed to each other. In the illustrated embodiment of the present disclosure, the first bending portion 3133 and the second bending portion 3143 are provided with a protrusion 3133*a* and a groove 3143*a* that are locked with each other. In addition, in order to improve the contact reliability of the first bending portion 3133 and the second bending portion 3143, the second bending portion 3143 is provided with an abutting arm 3143*b* in contact with the first bending portion 3133. Of course, in other embodiments, the abutting arm 3143*b* may also be provided on the first bending portion 3133, or both the first bending portion 3133 and the second bending portion 3143 include the abutting arm 3143*b*.

Both sides of the first ground shielding piece 315 are in contact with the first body portion 3131 of the first grounding piece 313 and the second body portion 3141 of the second grounding piece 314, respectively, so that the first ground shielding piece 315 is integrated with the first grounding piece 313 and the second grounding piece 314 to improve the shielding effect. In the illustrated embodiment of the present disclosure, each side of the first ground shielding piece 315 includes a protrusion 3151, and each of the first body portion 3131 and the second body portion 3141 defines a through hole 316 for fixing the protrusion 3151. This design is also beneficial to improve the overall strength of the first terminal module 31, so that the first terminal module 31 is not easy to be loose.

After the first terminal module 31 is assembled to the conductive body 20, the first contact arms 3112*a* of the first signal terminals 3112 and the second contact arms 3122*a* of the second signal terminals 3122 protrude into the receiving space 25 to contact with the mating signal terminals 202 of the mating connector in order to realize data transmission. The first ground arms 3132 of the first grounding piece 313 and the second ground arms 3142 of the second grounding piece 314 extend into the first mating cavities 231 and the second mating cavities 232, respectively, so as to be in contact with the ground pins 201 of the mating connector.

The structure of the second terminal module 32 is similar to that of the first terminal module 31.

Figure 14:
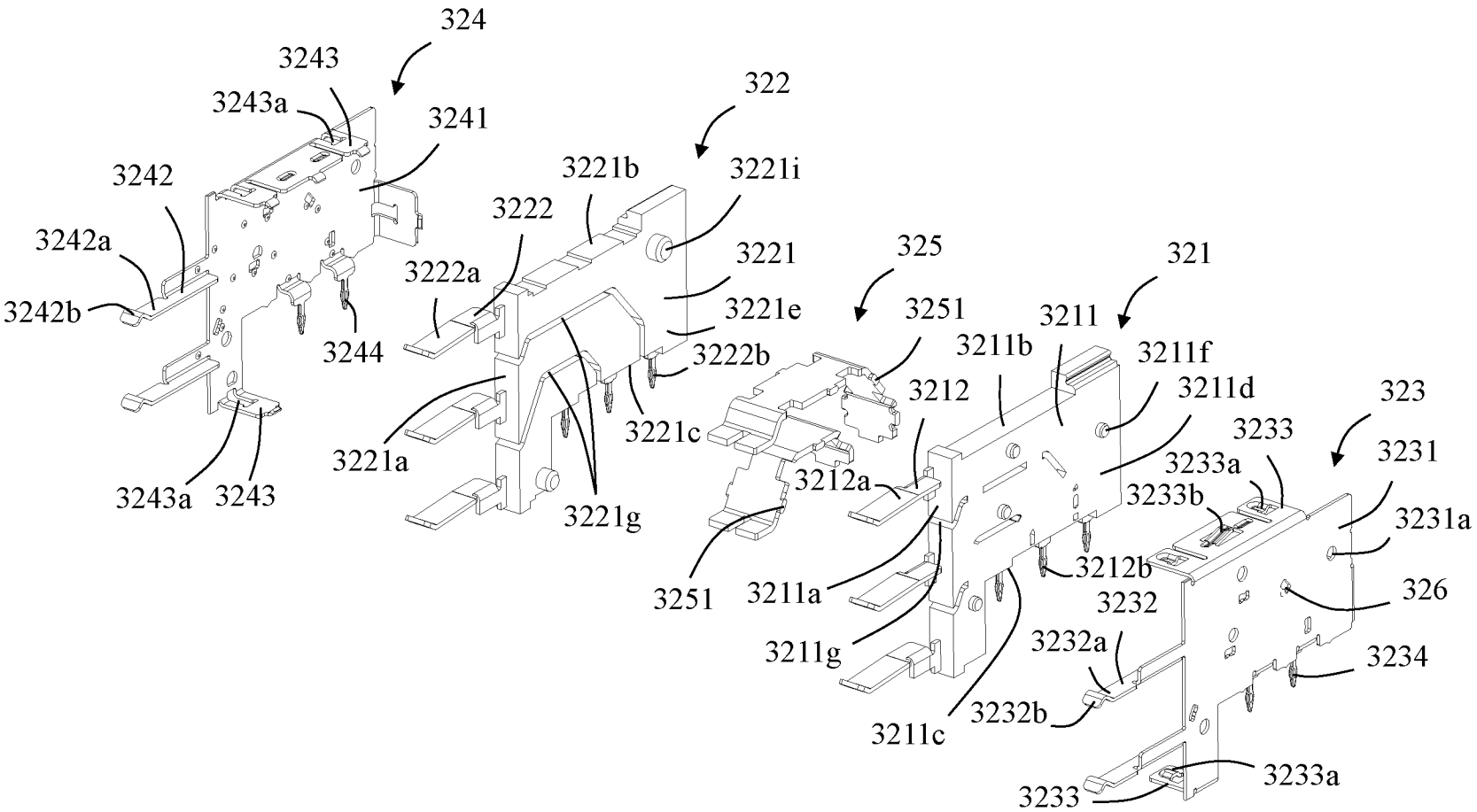
FIG. 14 is a perspective exploded view of a second terminal module in FIG. 11.
Figure 15:
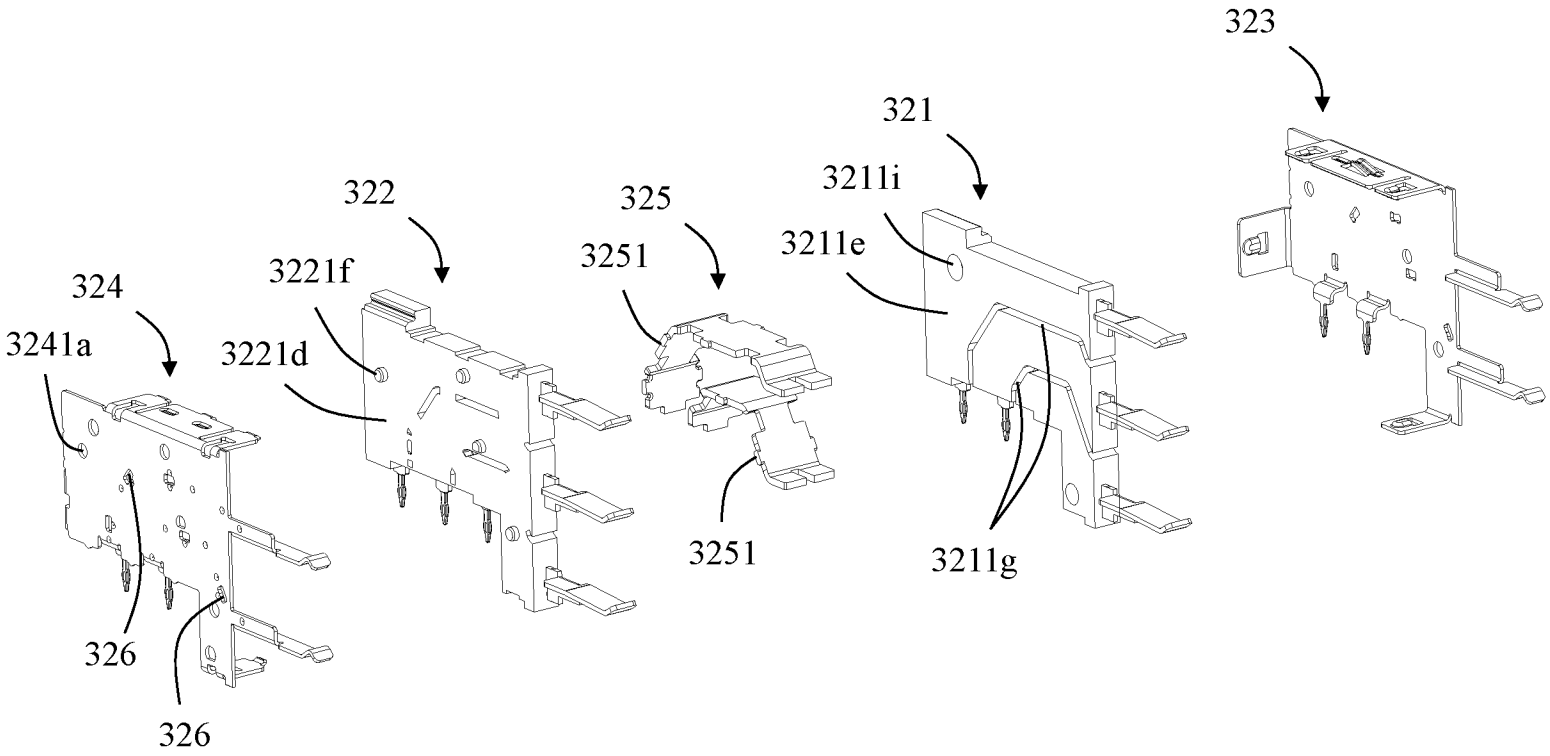
FIG. 15 is a perspective exploded view of FIG. 14 from another angle.

Referring to FIGS. 11, 14 and 15, in the illustrated embodiment of the present disclosure, each second terminal module 32 includes a third signal terminal module 321, a fourth signal terminal module 322, a third grounding piece 323 located on one side of the third signal terminal module 321, a fourth grounding piece 324 located on the other side of the fourth signal terminal module 322, and a plurality of second ground shielding pieces 325 retained in the third signal terminal module 321 and the fourth signal terminal module 322.

The third signal terminal module 321 includes a third insulating block 3211 and a plurality of third signal terminals 3212 fixed to the third insulating block 3211. In an embodiment of the present disclosure, the third signal terminals 3212 are insert-molded with the third insulating block 3211. The third insulating block 3211 includes a third front end surface 3211*a*, a third top surface 3211*b*, a third bottom surface 3211*c*, a fifth side surface 3211*d* facing the third grounding piece 323, and a sixth side surface 3211*e* facing the fourth signal terminal module 322. The third insulating block 3211 further includes a plurality of third fixing posts 3211*f* protruding beyond the fifth side surface 3211*d* and a third installation slot 3211*g* extending through the sixth side surface 3211*e*. In the illustrated embodiment of the present disclosure, the third installation slot 3211*g* does not extend at least partially through the fifth side surface 3211*d* so as to ensure the structural strength of the third signal terminal module 321. In the illustrated embodiment of the present disclosure, the third installation slot 3211*g* extends through the third front end surface 3211*a*.

The third signal terminal 3212 includes a third contact arm 3212*a* protruding forwardly beyond the third front end surface 3211*a* and a third mounting foot 3212*b* protruding downwardly beyond the third bottom surface 3211*c*.

The fourth signal terminal module 322 includes a fourth insulating block 3221 and a plurality of fourth signal terminals 3222 fixed to the fourth insulating block 3221. In an embodiment of the present disclosure, the fourth signal terminals 3222 are insert-molded with the fourth insulating block 3221. The fourth insulating block 3221 includes a fourth front end surface 3221*a*, a fourth top surface 3221*b*, a fourth bottom surface 3221*c*, a seventh side surface 3221*d* facing the fourth grounding piece 324, and an eighth side surface 3221*e* facing the third signal terminal module 321. The fourth insulating block 3221 further includes a plurality of fourth fixing posts 3221*f* protruding beyond the seventh side surface 3221*d* and a fourth installation slot 3221*g* extending through the eighth side surface 3221*e*. In the illustrated embodiment of the present disclosure, the fourth installation slot 3221*g* does not extend at least partially through the seventh side surface 3221*d* so as to ensure the structural strength of the fourth signal terminal module 322. In the illustrated embodiment of the present disclosure, the fourth installation slot 3221*g* extends through the fourth front end surface 3221*a*.

The third insulating block 3211 and the fourth insulating block 3221 are stacked together. The third insulating block 3211 and the fourth insulating block 3221 include a protrusion 3221*i* and a groove 3211*i* which mate with each other. The protrusion 3221*i* is provided on one of the third insulating block 3211 and the fourth insulating block 3221, and the groove 3211*i* is provided on the other of the third insulating block 3211 and the fourth insulating block 3221. This arrangement is beneficial for assembling the third insulating block 3211 and the fourth insulating block 3221 as a whole. Referring to FIGS. 14 and 15, in the illustrated embodiment of the present disclosure, the groove 3211*i* is defined in the third insulating block 3211, and the protrusion 3221*i* is disposed on the fourth insulating block 3221.

One side of the second ground shielding piece 325 is received in the third installation slot 3211*g*, and the other side of the second ground shielding piece 325 is received in the fourth installation slot 3221*g*. That is, the third installation slot 3211*g* and the fourth installation slot 3221*g* jointly receive the second ground shielding piece 325.

The fourth signal terminal 3222 includes a fourth contact arm 3222*a* protruding forwardly beyond the fourth front surface 3221*a* and a fourth mounting foot 3222*b* protruding downwardly beyond the fourth bottom surface 3221*c*.

The third grounding piece 323 includes a third body portion 3231, a plurality of third ground terminals 3232 extending forwardly from the third body portion 3231, third bending portions 3233 bent from the top and the bottom of the third body portion 3231 respectively and extending to a side of the fourth grounding piece 324, and a plurality of third ground pins 3234 extending downwardly from the bottom of the third body portion 3231. The third body portion 3231 includes a plurality of third positioning holes 3231*a* mating with the third fixing posts 3211*f*. The third ground terminal 3232 includes a third ground arm 3232*a* and a third ground contact portion 3232*b* located on the third ground arm 3132*a*. The third ground contact portion 3232*b* has an arc-shaped contact surface.

The fourth grounding piece 324 includes a fourth body portion 3241, a plurality of fourth ground terminals 3242 extending forwardly from the fourth body portion 3241, fourth bending portions 3243 bent from the top and the bottom of the fourth body portion 3241 respectively and extending to a side of the third grounding piece 323, and a plurality of fourth ground pins 3244 extending downwardly from the bottom of the fourth body portion 3241. The fourth body portion 3241 includes a plurality of fourth positioning holes 3241*a* mating with the fourth fixing posts 3221*f* The fourth ground terminal 3242 includes a fourth ground arm 3242*a* and a fourth ground contact portion 3242*b* located on the fourth ground arm 3242*a*. The fourth ground contact portion 3242*b* has an arc-shaped contact surface.

In addition, the third bending portions 3233 and/or the fourth bending portions 3243 include protruding metal abutting arms 3233*b*. In the illustrated embodiment of the present disclosure, the metal abutting arms 3233*b* and the third grounding piece 323 are integrally formed, and protrude upwardly beyond the third body portion 3231. Of course, in other embodiments, the metal abutting arms 3233*b* may also be disposed at the fourth bending portions 3243. Alternatively, both the third bending portions 3233 and the fourth bending portions 3243 include the metal abutting arms 3233*b*. The metal abutting arms 3233*b* are protruding and arranged side by side. In addition, referring to FIGS. 3, 4 and 11, the third insulating block 3211 and the fourth insulating block 3221 are spliced to form a holding protrusion 320 for jointly being clamped in the corresponding retaining slot 125. In other words, a part of the structure of the holding protrusion 320 is formed on the third insulating block 3211, and another part of the structure of the holding protrusion 320 is formed on the fourth insulating block 3221. When assembling the second terminal module 32 to the outer housing 10, the holding protrusion 320 mates with the corresponding retaining slot 125, thereby guiding the assembly on one hand; and preventing the third insulating block 3211 and the fourth insulating block 3221 from being loose with each other on the other hand.

In an embodiment of the present disclosure, when assembling the second terminal module 32, firstly two sides of the second ground shielding piece 325 are into the third installation slot 3211*g* of the third insulating block 3211 and the fourth installation slot 3221*g* of the four insulating block 3221. Then, the third insulating block 3211 and the fourth insulating block 3221 are brought close to each other to initially combine as a whole. After that, the third grounding piece 323 and the fourth grounding piece 324 are mounted on two side surfaces of the third insulating block 3211 and the fourth insulating block 3221, respectively. Two side surfaces (i.e., the fifth side surface 3211*d* and the seventh side surface 3221*d*) are away from each other. Through the cooperation of the third fixing posts 3211*f* and the third positioning holes 3231*a* and the cooperation of the fourth fixing posts 3221*f* and the fourth positioning holes 3241*a*, the third grounding plate 323 and the fourth grounding plate 324 are installed to the third insulating block 3211 and the fourth insulating block 3221. Finally, the third bending portions 3233 and the fourth bending portions 3243 are fixed to each other. In the illustrated embodiment of the present disclosure, the third bending portions 3233 and the fourth bending portions 3243 include locking protrusions 3233*a* and grooves 3243*a* mating with the locking protrusions 3233*a*.

Two sides of the second grounding shield 325 are in contact with the third body portion 3231 of the third grounding piece 323 and the fourth body portion 3241 of the fourth grounding piece 324, respectively, so that the second ground shielding piece 325 is connected to the third grounding piece 323 and the fourth grounding piece 324 as a whole to improve the shielding effect. In the illustrated embodiment of the present disclosure, each side of the second ground shielding piece 325 includes a protrusion 3251, and each of the third body portion 3231 and the fourth body portion 3241 includes a through hole 326 for fixing the protrusion 3251.

After the second terminal module 32 is assembled to the conductive body 20, the third contact arms 3212*a* of the third signal terminals 3212 and the fourth contact arms

3222*a* of the fourth signal terminals 3222 protrude into the receiving space 25 to contact with the mating signal terminals 202 of the mating connector so as to realize data transmission. The third ground arms 3232 of the third grounding piece 323 and the fourth ground arms 3242 of the fourth grounding piece 324 respectively extend into the first mating cavity 231 and the second mating cavity 232 so as to be in contact with the ground pins 201 of the mating connector.

Referring to FIGS. 6, 7, 16 to 19, the electrical connector 100 further includes a grounding element 4 fixed in the slot 26 along the insertion direction M. The top surface and the bottom surface of the slot 26 are used to limit the stroke of the grounding element 4 along the top-bottom direction, so that the grounding element 4 can be tightly retained in the slot 26 in the top-bottom direction. In an embodiment of the present disclosure, the grounding element 4 is made of a metal material.

Figure 16:
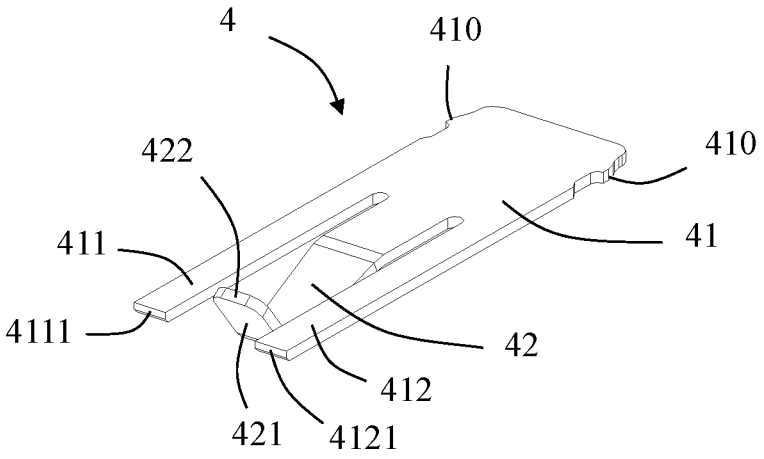
FIG. 16 is a perspective schematic view of a grounding piece in a first embodiment.
Figure 18:
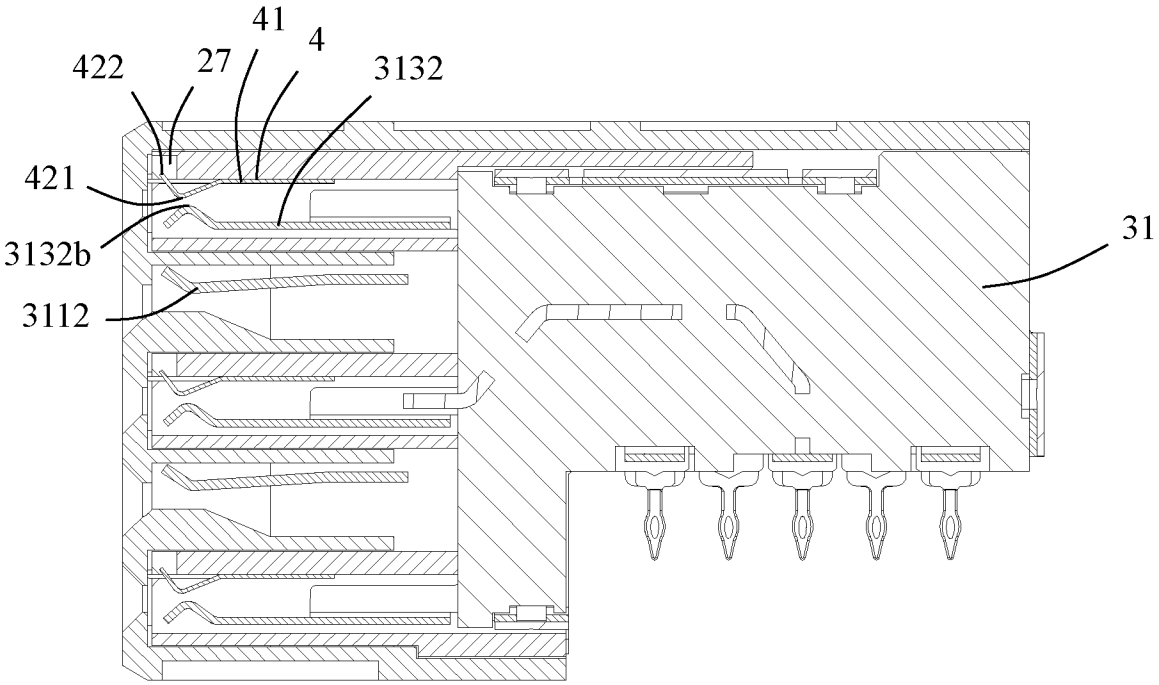
FIG. 18 is a schematic cross-sectional view taken along line C-C in FIG. 1.
Figure 21:
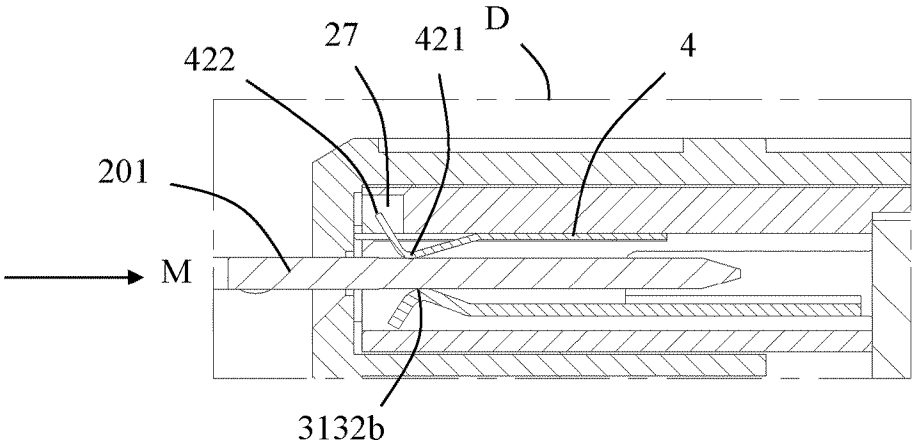
FIG. 21 is a partial enlarged view of a frame portion D in FIG. 19.

Referring to FIG. 16, in the first embodiment of the grounding element 4, the grounding element 4 includes a plate portion 41 fixed in the slot 26 and an extension arm 42 stamped from the plate portion 41. The plate portion 41 includes an interference structure (i.e., barbs 410). The interference structure is used to push or pierce a part of the conductive body 20 exposed in the slot 26 so as to improve the holding force. Therefore the grounding element 4 can be stably held in the slot 26. In an embodiment of the present disclosure, the plate portion 41 includes a first holding arm 411 and a second holding arm 412 located on two sides of the extension arm 42, respectively. The first holding arm 411 and the second holding arm 412 both extend in a direction opposite to the insertion direction M. The first holding arm 411 and the second holding arm 412 are spaced apart from each other in the left-right direction. Free ends 4111, 4121 of the first holding arm 411 and the second holding arm 412 respectively extend to the front end of the slot 26, that is, a position close to the first end surface 21 (referring to FIG. 7). With this arrangement, on one hand, the overall fixing effect of the plate portion 41 is better; on the other hand, the overall shielding area of the grounding element 4 can be increased so as to improve the shielding effect. The extension arm 42 includes a ground mating portion 421 at least partially located in the mating cavity 23. An extension direction of the extension arm 42 is opposite to the insertion direction M. With this arrangement, on one hand, the length of the extension arm 42 can be made longer, thereby improving the elastic deformation ability; on the other hand, it is easy to design the grounding butting portion 421 closer to the first end surface 21, so that the contact position is closer to a root of the corresponding ground pin 201 of the mating connector. As a result, it is beneficial to improve the high frequency performance. The root is an end of the ground pin 201 opposite to the insertion direction M. The extension arm 42 has a free end 422 connected to the grounding butting portion 421. Referring to FIG. 18, when the ground pin 201 of the mating connector is not inserted into the electrical connector 100, the free end 422 extends beyond the plate portion 41 in a direction away from the grounding butting portion 421. That is, the free end 422 extends upwardly beyond the plate portion 41. Such a configuration can avoid damage to the extension arm 42 when the ground pin 201 of the mating connector is inserted into the mating cavity 23. The free end 422 is received in the receiving groove 27. Referring to FIG. 21, when the ground pin 201 of the mating connector is inserted into the electrical connector 100, the free end 422 can be elastically deformed in the receiving groove 27 to a certain extent.

Figure 17:
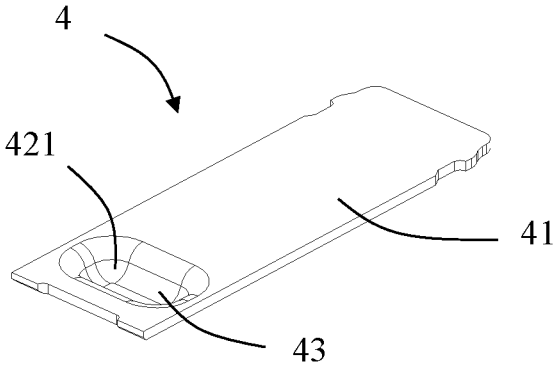
FIG. 17 is a perspective schematic view of the grounding piece in a second embodiment.
Figure 22:
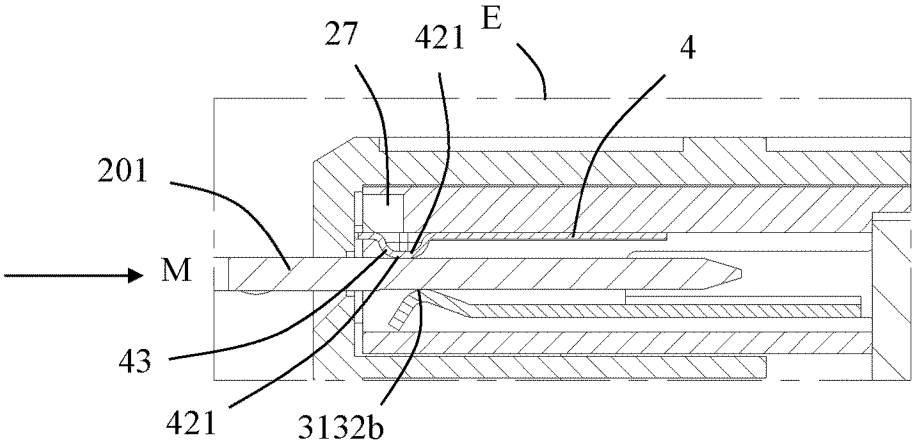
FIG. 22 is a partial enlarged view of a frame portion E in FIG. 20.

Referring to FIGS. 17, 20 and 22, in a second embodiment of the grounding element 4, the grounding element 4 includes a plate portion 41 fixed in the slot 26 and a ground mating portion 421 at least partially located in the mating cavity 23. The ground mating portion 421 includes a convex hull 43 formed by stamping the plate portion 41. The convex hull 43 is closer to the first end surface 21 than the first and second ground contact portions 3132*b*, 3142*b*, so that the contact position is closer to the root of the ground pin 201 of the mating connector. As a result, it is beneficial to improve the high frequency performance.

When the mating connector and the electrical connector 100 are mated with each other, the first ground contact portion 3132*b* (or the second ground contact part 3142*b*) and the ground mating portion 421, which are located in the same mating cavity 23, are in contact with the same ground pin 201 of the mating connector. The first and second ground contact portions 3132*b*, 3142*b* and the ground mating portion 421 are all surrounded by the conductive plastic, thereby improving the shielding effect.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising:

a conductive body, the conductive body comprising a first end surface, a second end surface away from the first end surface, and a mating cavity extending through the first end surface; and a terminal module, the terminal module being assembled to the conductive body from the second end surface, the terminal module comprising an insulating block, a plurality of signal terminals fixed to the insulating block, and a grounding piece mounted to the insulating block, the grounding piece comprising a body portion located on a side surface of the insulating block and a ground terminal connected to the body portion, the ground terminal comprising a ground contact portion at least partially located in the mating cavity;

wherein the conductive body further defines a slot extending through the first end surface in a direction opposite to an insertion direction of a mating connector; the electrical connector comprises a grounding element retained in the slot, the grounding element comprises a ground mating portion at least partially located in the mating cavity, and the ground contact portion and the ground mating portion are adapted to contact a same ground pin of the mating connector;

wherein the terminal module comprises a first signal terminal module, a second signal terminal module, a first grounding piece located on one side of the first signal terminal module, and a second grounding piece located on the other side of the second signal terminal module;

the first signal terminal module comprises a first insulating block and a plurality of first signal terminals fixed to the first insulating block;

the first grounding piece comprises a first body portion located on a side surface of the first insulating block and a first ground terminal connected to the first body portion, and the first ground terminal comprises a first ground contact portion;

the second signal terminal module comprises a second insulating block and a plurality of second signal terminals fixed to the second insulating block;

the second grounding piece comprises a second body portion located on a side surface of the second insulating block and a second ground terminal connected to the second body portion, and the second ground terminal comprises a second ground contact portion;

wherein the first body portion and the second body portion are located on two side surfaces of the first insulating block and the second insulating block, respectively; and wherein the two side surfaces are far away from each other;

wherein the first grounding piece comprises a first bending portion extending towards the second body portion, the second grounding piece comprises a second bending portion extending towards the first body portion, and the first bending portion and the second bending portion are fixed to each other;

wherein the electrical connector further comprises an outer housing, and the outer housing comprising a locking groove; and wherein the first bending portion and/or the second bending portion comprises a metal abutting arm locked in the locking groove; and/or the first insulating block and/or the second insulating block comprises a plastic abutting arm locked in the locking groove.

2. The electrical connector according to claim 1, wherein the grounding element is assembled to the conductive body along the insertion direction, and the terminal module is assembled to the conductive body along a direction opposite to the insertion direction.

3. The electrical connector according to claim 1, wherein the ground terminal comprises a ground arm extending into the mating cavity, and the ground contact portion is provided on the ground arm; and wherein the grounding element comprises a plate portion and an extension arm, the plate portion is at least partially inserted into the slot, and the ground mating portion is provided on the extension arm.

4. The electrical connector according to claim 3, wherein the extension arm comprises a free end connected to the ground mating portion, and the free end extends beyond the plate portion in a direction away from the ground mating portion; and wherein the conductive body defines a receiving groove communicating with the slot, and the free end is received in the receiving groove.

5. The electrical connector according to claim 3, wherein the plate portion comprises a first holding arm and a second holding arm which are located on two sides of the extension arm, respectively; both the first holding arm and the second holding arm extend in a direction opposite to the insertion direction; the first holding arm and the second holding arm are spaced apart from each other; and free ends of the first holding arm and the second holding arm respectively extend to a position where the slot is adjacent to the first end surface.

6. The electrical connector according to claim 1, wherein the ground terminal comprises a ground arm extending into the mating cavity, and the ground contact portion is provided on the ground arm; and wherein the grounding element comprises a plate portion at least partially inserted into the slot, and the ground mating portion comprises a convex hull formed by stamping the plate portion.

7. The electrical connector according to claim 6, wherein the convex hull is closer to the first end surface than the ground contact portion.

8. The electrical connector according to claim 1, wherein one of the first bending portion and the second bending portion comprises a protrusion, and a remaining one of the first bending portion and the second bending portion comprises a groove to lock with the protrusion.

9. The electrical connector according to claim 1, wherein the conductive body is made of a conductive plastic, and both the ground contact portion and the ground mating portion are surrounded by the conductive plastic.

10. The electrical connector according to claim 1, further comprising an outer housing, the outer housing defining a plurality of guiding grooves, and the conductive body comprising a plurality of ribs to mate with the guiding grooves.

11. An electrical connector, comprising:

a conductive body, the conductive body comprising a first end surface, a second end surface away from the first end surface, and a mating cavity extending through the first end surface; and a terminal module, the terminal module being assembled to the conductive body from the second end surface, the terminal module comprising an insulating block, a plurality of signal terminals fixed to the insulating block, and a grounding piece mounted to the insulating block, the grounding piece comprising a body portion located on a side surface of the insulating block and a ground terminal connected to the body portion, the ground terminal comprising a ground contact portion at least partially located in the mating cavity;

wherein the conductive body further defines a slot extending through the first end surface in a direction opposite to an insertion direction of a mating connector; the electrical connector comprises a grounding element retained in the slot, the grounding element comprises a ground mating portion at least partially located in the mating cavity, and the ground contact portion and the ground mating portion are adapted to contact a same ground pin of the mating connector;

wherein the terminal module comprises a first signal terminal module, a second signal terminal module, a first grounding piece located on one side of the first signal terminal module, and a second grounding piece located on the other side of the second signal terminal module;

the first signal terminal module comprises a first insulating block and a plurality of first signal terminals fixed to the first insulating block;

the first grounding piece comprises a first body portion located on a side surface of the first insulating block and a first ground terminal connected to the first body portion, and the first ground terminal comprises a first ground contact portion;

the second signal terminal module comprises a second insulating block and a plurality of second signal terminals fixed to the second insulating block;

the second grounding piece comprises a second body portion located on a side surface of the second insulating block and a second ground terminal connected to the second body portion, and the second ground terminal comprises a second ground contact portion;

wherein the conductive body comprises a plurality of mating extensions and a plurality of receiving spaces, each receiving space is located between two adjacent mating extensions along a spacing direction perpendicular to the insertion direction, the mating cavity includes a first mating cavity and a second mating cavity which extend through corresponding mating extension in a direction opposite to the insertion direction, the first mating cavity and the second mating cavity are arranged side by side;

wherein the first signal terminal comprises a first contact arm, the second signal terminal comprises a second contact arm, and the first contact arm and the second contact arm extend into the receiving space; and wherein the first ground contact portion is located in the first mating cavity, and the second ground contact portion is located in the second mating cavity.

12. An electrical connector assembly, comprising:

an electrical connector, comprising:

a conductive body, the conductive body comprising a first end surface, a mating cavity extending through the first end surface, and a slot extending through the first end surface;

a terminal module, the terminal module being assembled to the conductive body, the terminal module comprising an insulating block, a plurality of signal terminals fixed to the insulating block, and a grounding piece mounted to the insulating block, the grounding piece comprising a body portion located on a side surface of the insulating block and a ground terminal connected to the body portion, the ground terminal comprising a ground contact portion at least partially located in the mating cavity; wherein the terminal module comprises a first signal terminal module and a second signal terminal module; the first signal terminal module comprises a first insulating block and a plurality of first signal terminals fixed to the first insulating block; the second signal terminal module comprises a second insulating block and a plurality of second signal terminals fixed to the second insulating block; the grounding piece comprises a first grounding piece located on one side of the first signal terminal module, and a second grounding piece located on the other side of the second signal terminal module;

a grounding element comprising a plate portion retained in the slot, and a ground mating portion stamped from the plate portion, the ground mating portion being at least partially located in the mating cavity, the ground contact portion and the ground mating portion being located on opposite sides of the mating cavity, respectively; and an outer housing comprising a locking groove; and a mating connector, comprising a ground pin;

wherein when the mating connector is mating with the electrical connector along an insertion direction, the ground pin is received in the mating cavity, and the ground pin of the mating connector is clamped by the ground contact portion and the ground mating portion of the electrical connector;

wherein the first grounding piece comprises a first bending portion extending towards the second body portion, the second grounding piece comprises a second bending portion extending towards the first body portion, and the first bending portion and the second bending portion are fixed to each other;

wherein the first bending portion and/or the second bending portion comprises a metal abutting arm locked in the locking groove; and/or the first insulating block and/or the second insulating block comprises a plastic abutting arm locked in the locking groove.

13. The electrical connector assembly according to claim 12, wherein the grounding element is assembled to the conductive body along the insertion direction, and the terminal module is assembled to the conductive body along a direction opposite to the insertion direction.

14. The electrical connector assembly according to claim 12, wherein the ground terminal comprises a ground arm extending into the mating cavity, and the ground contact portion is provided on the ground arm; wherein the grounding element comprises an extension arm, and the ground mating portion is provided on the extension arm; wherein the extension arm comprises a free end connected to the ground mating portion, and the free end extends beyond the plate portion in a direction away from the ground mating portion; and wherein the conductive body defines a receiving groove communicating with the slot, and the free end is received in the receiving groove.

15. The electrical connector assembly according to claim 12, wherein the ground terminal comprises a ground arm extending into the mating cavity, and the ground contact portion is provided on the ground arm; wherein the ground mating portion comprises a convex hull formed by stamping the plate portion; and wherein the convex hull is closer to the first end surface than the ground contact portion.

16. The electrical connector assembly according to claim 12, wherein the conductive body is made of a conductive plastic, and both the ground contact portion and the ground mating portion are surrounded by the conductive plastic.

* * * * *